US010557223B2

(12) United States Patent
Wu

(10) Patent No.: US 10,557,223 B2
(45) Date of Patent: Feb. 11, 2020

(54) WOVEN CLOTH

(71) Applicant: Tsung-Jung Wu, Taichung (TW)

(72) Inventor: Tsung-Jung Wu, Taichung (TW)

( * ) Notice: Subject to any disclaimer, the term of this patent is extended or adjusted under 35 U.S.C. 154(b) by 239 days.

(21) Appl. No.: 15/654,239

(22) Filed: Jul. 19, 2017

(65) Prior Publication Data

US 2019/0024273 A1 Jan. 24, 2019

(51) Int. Cl.
*D03D 25/00* (2006.01)
*D03D 15/00* (2006.01)

(52) U.S. Cl.
CPC ..... *D03D 25/005* (2013.01); *D03D 15/0094* (2013.01); *D10B 2403/021* (2013.01); *D10B 2403/0331* (2013.01)

(58) Field of Classification Search
None
See application file for complete search history.

(56) References Cited

FOREIGN PATENT DOCUMENTS

| | | | |
|---|---|---|---|
| FR | 2205072 | * | 5/1974 |
| TW | M455021 | | 6/2013 |

OTHER PUBLICATIONS

Machine translation of FR2205072; Nebon (Year: 1974).*

* cited by examiner

*Primary Examiner* — Shawn Mckinnon
*Assistant Examiner* — Lashawnda T McKinnon
(74) *Attorney, Agent, or Firm* — Muncy, Geissler, Olds & Lowe, P.C.

(57) ABSTRACT

The woven cloth includes a plurality of first threads, a plurality of second threads, and a plurality of third threads. Each first thread and each second thread are woven by a plurality of filaments respectively. Each first thread is interwoven with and ties the plurality of second threads and is interwoven with and ties at least part of the plurality of third threads. The third threads are not interwoven with the plurality of the second threads.

8 Claims, 4 Drawing Sheets

WOVEN CLOTH

BACKGROUND OF THE INVENTION

Field of the Invention

The present invention relates to woven cloth.

Description of the Prior Art

The woven cloth is used widely. For examples, clothes, shoes, and daily commodities are often made by woven cloth. However, a method of the woven cloth production, the material, and the design determine the characteristics of the woven cloth deeply.

Wherein, conventional woven cloth is shown in patents TW M455021. The woven cloth is woven by threads along a longitudinal directions and a lateralwise direction. In conventional woven cloth, it usually additionally sews a pattern on a surface to make three-dimension structures thereon. Besides, if it needs the three-dimension structures in greater thickness on the surface of the woven cloth, it should sew the three-dimension structures overlapped repeatedly, thus it must spend a lot of time on production. Besides, if the additional three-dimension structure is additionally attached to the woven cloth by adhesives or sewing, it is being easily to detach from the woven cloth.

The present invention is, therefore, arisen to obviate or at least mitigate the above mentioned disadvantages.

SUMMARY OF THE INVENTION

An object of the present invention is to provide woven cloth with the three-dimension structures which are made integrally therewith.

To achieve the above and other objects, woven cloth is provided. The woven cloth includes a plurality of first threads, a plurality of second threads, and a plurality of third threads. Each first thread and each second thread are woven by a plurality of filaments respectively. Each first thread is interwoven with and ties the plurality of second threads and is interwoven with and ties at least part of the plurality of third threads. The third threads are not interwoven with the plurality of the second threads.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
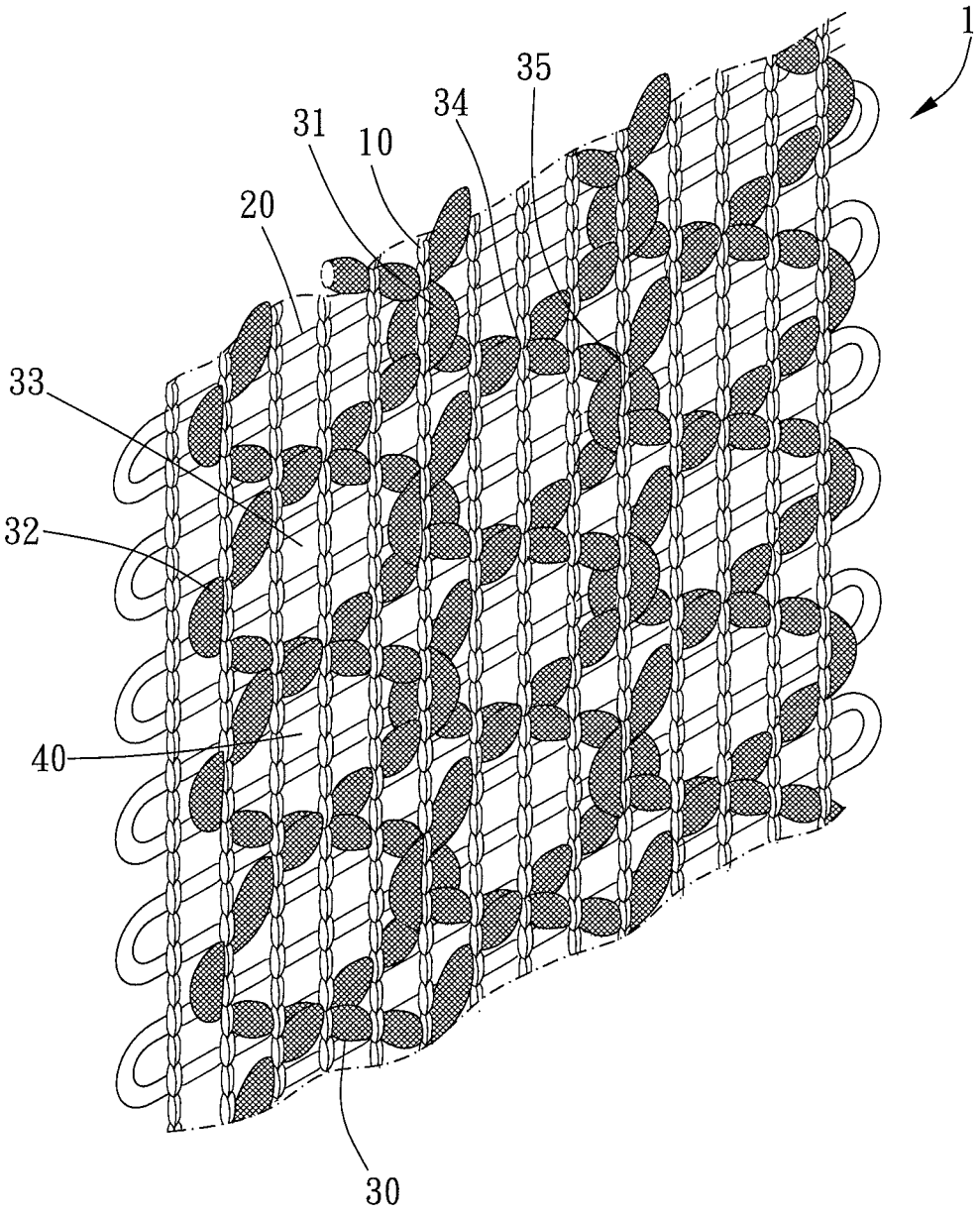
FIG. 1 is a stereogram of a preferred embodiment of the present invention.
Figure 2:
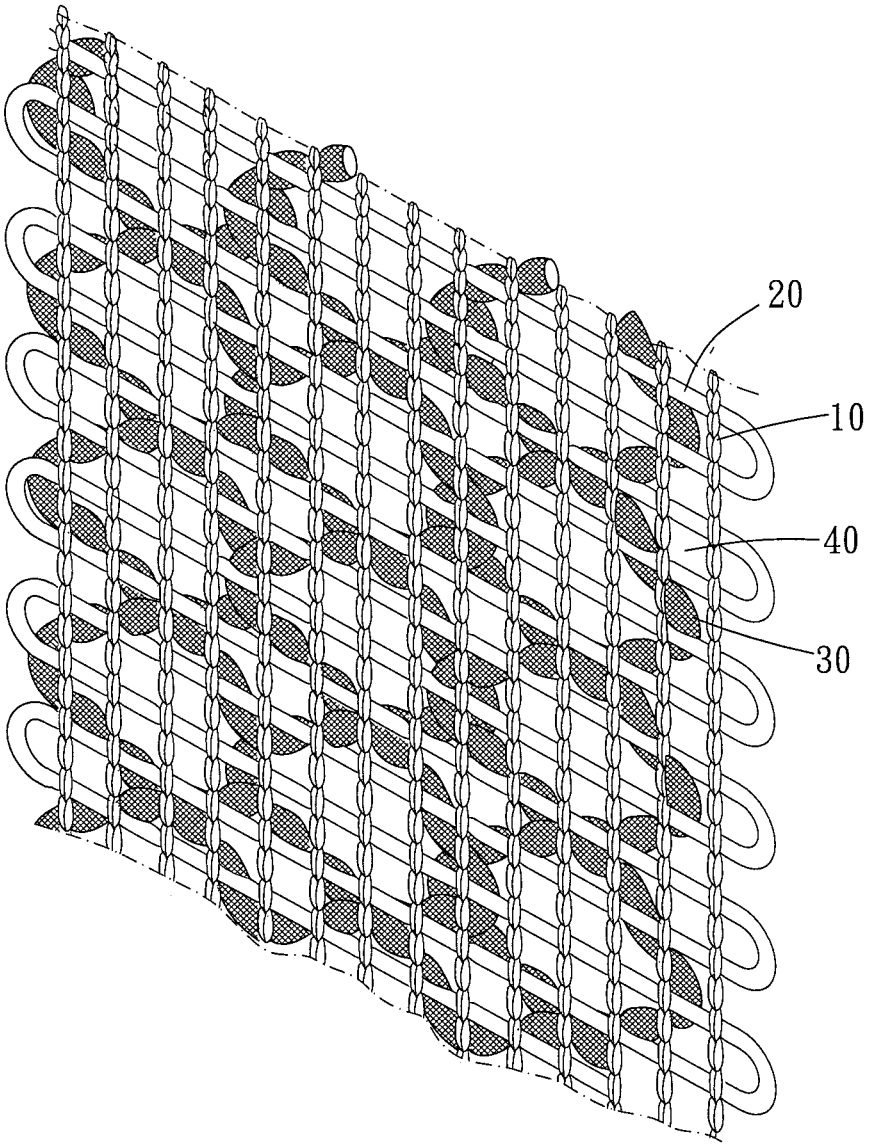
FIG. 2 is another stereogram of a preferred embodiment of the present invention.

FIGS. 1-4 show woven cloth according to a preferred embodiment of the present invention. The woven cloth 1 includes a plurality of first threads 10, a plurality of second threads 20, and a plurality of third threads 30. Each of the plurality of first threads 10 and each of the plurality of second threads 20 are woven by a plurality of filaments respectively. Each of the plurality of first threads 10 is interwoven with and ties the plurality of second threads 20 and is interwoven with and ties at least part of the plurality of third threads 30. The third threads 30 are not interwoven with the plurality of the second threads 20. Specifically, each of the plurality of first threads 10 and each of the plurality of second threads 20 is woven by braiding. Thus the woven cloth 1 is with the three-dimension structures which are made integrally therewith.

Wherein, each of the plurality of third threads 30 is disposed transversely to at least one of the plurality of first threads 10 and the plurality of second threads 20, for example each of the plurality of third threads 30 is parallel to each of the plurality of first threads 10. The plurality of first threads 10 are spaced in intervals, the plurality of second threads 20 are spaced in intervals and interwoven with the plurality of first threads 10 to form a plurality of meshes 40, and at least part of each of the plurality of third threads 30 passes through and protrudes out of at least one of the plurality of meshes 40 so as to form the three dimensional structure on a side of the woven cloth 1. Preferably, the plurality of first threads 10 are disposed in parallel; the plurality of second threads 20 are disposed in parallel. In other embodiment, the plurality of first threads 10 and the plurality of second threads 20 can be non-parallel respectively.

Figure 3:
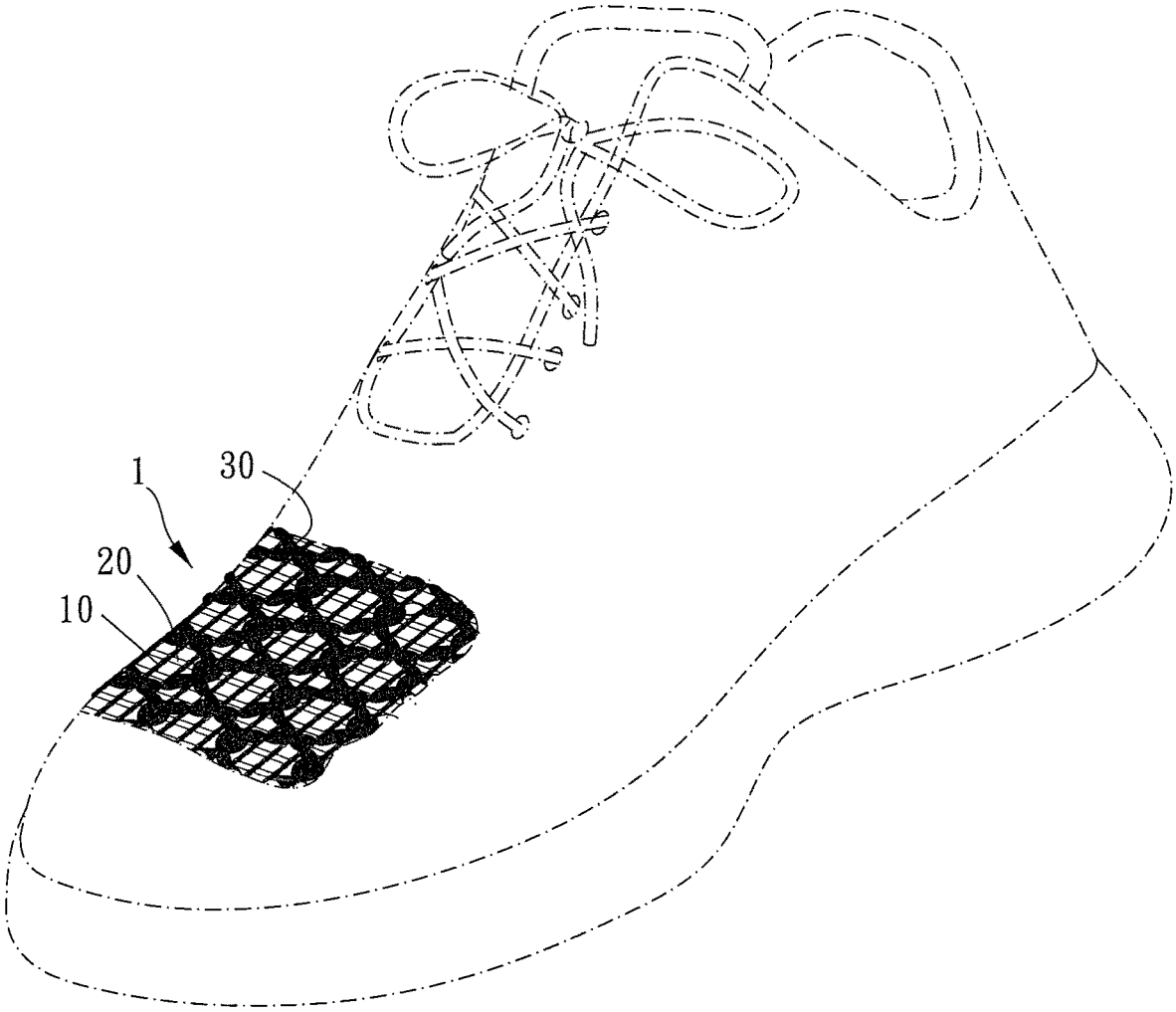
FIG. 3 is drawing showing the preferred embodiment of the present invention in use.
Figure 4:
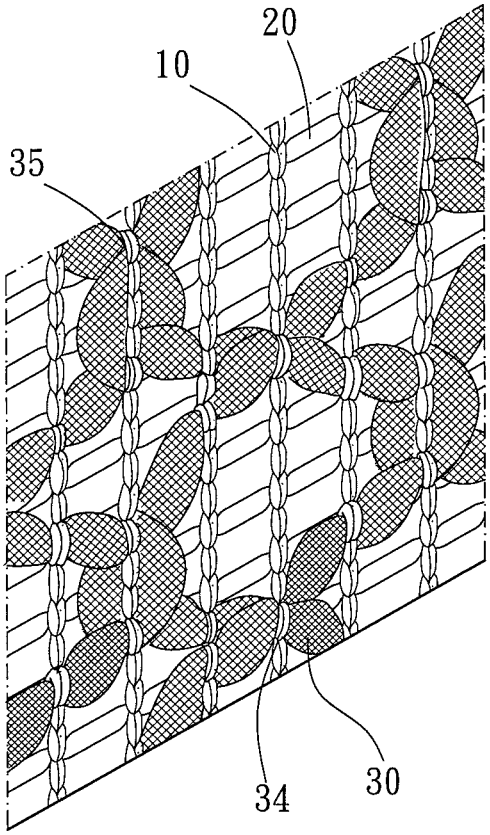
FIG. 4 is a partially-enlarged view of FIG. 1.

Each of the plurality of third threads 30 is softer than each of the plurality of first and second threads 10, 20. In this embodiment, each of the plurality of third threads 30 is woven by soft nylon materials, elastic fabrics or other soft filaments to apply to an upper of shoe (as shown in FIG. 3) for instance, so as to reduce the stress from the upper of shoe to make an instep comfortable when the upper of shoe covers the instep. Besides, each of the plurality of third threads 30 is greater than each of the plurality of first and second threads 10, 20 in outer diameter; preferably, each of the plurality of third threads 30 has an outer diameter greater than 3 times an outer diameter of each of the plurality of first threads 10; thus each of the plurality of third threads 30 can be tied around by one of the plurality of first threads 10 so as to partially squeeze into the plurality of meshes 40 and extrude of the woven cloth 1 to form the three-dimensional structures on the two sides of the woven cloth 1. In this embodiment, each of the plurality of third threads 30 is disposed on the same side of the woven cloth 1; each of the plurality of third threads 30 can be disposed on the different sides of the woven cloth 1.

At least part of each of the plurality of first threads 10 forms a loop which ties around at least one of the plurality of second threads 20 and at least one of the plurality of third threads 30, thus the at least one plurality of third threads 30 connects with the at least one plurality of second threads 20 tightly.

Each of the plurality of third threads 30 has a plurality of wave crests 31 and a plurality of wave troughs 32 arranged alternatively, the plurality of wave crests 31 and the plurality of wave troughs 32 of the at least adjacent two of the third threads 30 are arranged toward two opposite sides of the woven cloth 1 and form a plurality of mesh portions 33 correspondingly above the plurality of meshes 40, each of the plurality of mesh portions 33 is as a space for the plurality of third threads 30 to deform and compress. In this embodiment, each of the plurality of mesh portions 33 is communicated with part of the plurality of meshes 40. The adjacent two of the third threads 30 can be arranged toward the same side of the woven cloth 1. Preferably, the plurality of mesh portions 33 are the same size. In this embodiment, each of the plurality of third threads 30 extends in a meandering way by the plurality of wave crests 31 and the plurality of wave troughs 32. Each of the plurality of third threads 30 can also extend in a zigzag way.

More specifically, at least one of the plurality of wave crests 31 and at least one of the plurality of wave troughs 32 of the at least adjacent two of the third threads 30 overlap and form at least one first overlapped portion 34. In this embodiment, the at least one first overlapped portion 34 is plural in number, and the plurality of first overlapped portions 34 are arranged separately by a same distance. At least one of the first threads 10 ties and knots around the at least one of first overlapped portion 34. In this embodiment, each first thread 10 ties around the plurality of first overlapped portion 34. At least one of the plurality of wave crests 31 and at least one of the plurality of wave troughs 32 of the at least adjacent two of the third threads 30 overlap and form at least one second overlapped portion 35. In this embodiment, the at least one second overlapped portion 35 is plural in number, thus adjacent two of the third threads 30 can be connected with each other, and connected with each of the plurality of second threads 20 tightly. Moreover, at least part of the plurality of first overlapped portions 34 and at least part of the plurality of second overlapped portions 35 tie around one of the plurality of second threads 20 by one of the plurality of first threads 10, so that each of the plurality third threads 30 can be connected with the plurality of first threads 10 and the plurality of second threads 20 tightly. Furthermore, each of the plurality of first threads 10 ties around the plurality of first overlapped portions 34, each of the plurality of second overlapped portions 35 and between each of the plurality of first overlapped portions 34 and second overlapped portions 35.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A woven cloth, including: a plurality of first threads, a plurality of second threads, and a plurality of third threads; each of the plurality of first threads and each of the plurality of second threads woven by a plurality of filaments respectively; each of the plurality of first threads interwoven with and tie the plurality of second threads and interwoven with and tie at least part of the plurality of third threads; the third threads being not interwoven with the plurality of second threads;

wherein each of the plurality of third threads has a plurality of wave crests and a plurality of wave troughs arranged alternatively, the plurality of wave crests and the plurality of wave troughs of the at least adjacent two of the third threads are arranged toward two opposite sides of the woven cloth and form a plurality of mesh portions above a plurality of meshes formed by the plurality of first threads and the plurality of second threads;

wherein at least one of the plurality of wave crests and at least one of the plurality of wave troughs of the at least adjacent two of the third threads overlap and form at least one first overlapped portion and at least one second overlapped portion.

2. The woven cloth of claim 1, wherein the plurality of first threads are spaced in intervals, the plurality of second threads are spaced in intervals and interwoven with the plurality of first threads to form the plurality of meshes, and at least part of each of the plurality of third threads passes through and protrudes out of at least one of the plurality of meshes.

3. The woven cloth of claim 1, wherein each of the plurality of third threads is greater than each of the plurality of first and second threads in outer diameter.

4. The woven cloth of claim 1, wherein each of the plurality of third threads is softer than each of the plurality of first and second threads.

5. The woven cloth of claim 1, wherein at least part of each of the plurality of first threads forms a loop which ties around at least one of the plurality of second threads and at least one of the plurality of third threads.

6. The woven cloth of claim 1, wherein at least one of the first threads ties and knots around the at least one of first overlapped portion.

7. The woven cloth of claim 1, wherein each of the plurality of third threads is disposed on the same side of the woven cloth.

8. The woven cloth of claim 6, wherein the plurality of first threads are spaced in intervals, the plurality of second threads are spaced in intervals and interwoven with the plurality of first threads to form the plurality of meshes, and at least part of each of the plurality of third threads passes through and protrudes out of at least one of the plurality of meshes; the plurality of first threads are disposed in parallel; the plurality of second threads are disposed in parallel; each of the plurality of third threads is greater than each of the plurality of first and second threads in outer diameter; each of the plurality of third threads has an outer diameter greater than 3 times an outer diameter of each of the plurality of first threads; each of the plurality of third threads is softer than each of the plurality of first and second threads; each of the plurality of third threads is woven by soft nylon materials or elastic fabrics; at least part of each of the plurality of first threads forms a loop which ties around at least one of the plurality of second threads and at least one of the plurality of third threads; the plurality of mesh portions are the same size; the at least one first overlapped portion is plural in number, and the plurality of first overlapped portions are arranged separately by a same distance, the at least one second overlapped portion is plural in number; each of the plurality of mesh portions is communicated with part of the plurality of meshes; each of the plurality of third threads is disposed on the same side of the woven cloth; each of the plurality of third threads is disposed transversely to at least one of the plurality of first threads and the plurality of second threads; each of the plurality of first threads ties around the plurality of first overlapped portions, each of the plurality of second overlapped portions and between each of the plurality of first overlapped portions and second overlapped portions; at least part of the plurality of first overlapped portions and at least part of the plurality of second overlapped portions tie around one of the plurality of second threads by one of the plurality of first threads.

* * * * *